US010906763B2

(12) United States Patent
Chretien

(10) Patent No.: US 10,906,763 B2
(45) Date of Patent: Feb. 2, 2021

(54) SYSTEM FOR SUPPORTING A REEL OF STAMPING FOIL, AN UNWINDER MODULE, A STAMPING MACHINE, AND A METHOD FOR POSITIONING A REEL

(71) Applicant: BOBST MEX SA, Mex (CH)

(72) Inventor: Julien Chretien, Métabief (FR)

(73) Assignee: BOBST MEX SA

( * ) Notice: Subject to any disclaimer, the term of this patent is extended or adjusted under 35 U.S.C. 154(b) by 324 days.

(21) Appl. No.: 15/525,729

(22) PCT Filed: Nov. 6, 2015

(86) PCT No.: PCT/EP2015/025076
§ 371 (c)(1),
(2) Date: May 10, 2017

(87) PCT Pub. No.: WO2016/078774
PCT Pub. Date: May 26, 2016

(65) Prior Publication Data
US 2018/0327208 A1 Nov. 15, 2018

(30) Foreign Application Priority Data
Nov. 21, 2014 (EP) ..... 14020090

(51) Int. Cl.
*B65H 16/06* (2006.01)
*B41F 13/03* (2006.01)
(Continued)

(52) U.S. Cl.
CPC ..... *B65H 16/06* (2013.01); *B41F 13/02* (2013.01); *B41F 13/03* (2013.01); *B41F 13/08* (2013.01);
(Continued)

(58) Field of Classification Search
CPC .... B65H 16/06; B65H 23/063; B65H 19/126; B65H 2511/12; B65H 2403/7255;
(Continued)

(56) References Cited

U.S. PATENT DOCUMENTS 1,327,046 A * 1/1920 James ..... F16D 49/00 188/164
3,456,895 A * 7/1969 Scordato ..... B65H 45/103 242/422.3
(Continued)

FOREIGN PATENT DOCUMENTS

EP 1 588 968 A1 10/2005
GB 396814 8/1933
WO WO 2013/143664 10/2013

OTHER PUBLICATIONS

International Search Report dated Feb. 17, 2016 in corresponding PCT International Application No. PCT/EP2015/025076.
(Continued)

*Primary Examiner* — William A. Rivera
(74) *Attorney, Agent, or Firm* — Ostrolenk Faber LLP

(57) ABSTRACT

A system for supporting a reel of stamping foil (2) that is mounted rotatably, includes: two flanges (9, 9') connected to the shaft of the reel (2, 2') that is positioned between the flanges, each flange having a rotary shaft extending outward of the reel; two end walls (7, 7') mounted spaced apart on a guide surface (3'), each wall end having at least one upwardly oriented notch (10, 10') arranged to receive the shaft of each flange (9, 9'); and a brake (13) which cooperates with and slows the rotation of the reel (2).

17 Claims, 5 Drawing Sheets

(51) Int. Cl.

| | |
|---|---|
| ***B41F 13/08*** | (2006.01) |
| ***B65H 23/06*** | (2006.01) |
| ***B65H 19/12*** | (2006.01) |
| ***B41F 13/02*** | (2006.01) |

(52) U.S. Cl.
CPC ..... *B65H 19/126* (2013.01); *B65H 23/063* (2013.01); *B65H 2301/41306* (2013.01); *B65H 2301/41346* (2013.01); *B65H 2301/41366* (2013.01); *B65H 2301/413683* (2013.01); *B65H 2301/4493* (2013.01); *B65H 2301/5126* (2013.01); *B65H 2403/7255* (2013.01); *B65H 2511/12* (2013.01)

(58) Field of Classification Search
CPC .... B65H 2301/5126; B65H 2301/4493; B65H 2301/413683; B65H 2301/41366; B65H 2301/41346; B65H 2301/41306; B41F 13/08; B41F 13/02; B41F 13/03
See application file for complete search history.

(56) References Cited

U.S. PATENT DOCUMENTS 3,683,798 A * 8/1972 Kreuschmer ..... B41F 19/06 101/27
4,139,165 A * 2/1979 Dyck ..... B65H 18/103 242/421
4,288,275 A * 9/1981 Davis ..... B41F 19/062 101/25
4,304,369 A * 12/1981 Landsness ..... B65H 23/06 242/156.2
4,340,438 A * 7/1982 Davis ..... B41F 19/062 101/25
4,441,664 A * 4/1984 Stohlquist ..... B65H 23/08 226/111
5,441,589 A * 8/1995 Groswith, III ..... B41F 19/068 101/27
5,709,481 A * 1/1998 Hinojosa ..... B65H 16/06 242/421.8
6,607,158 B1 * 8/2003 Fischer ..... B65B 13/18 242/420.1
7,380,743 B2 * 6/2008 Martin ..... B65H 16/021 242/420.1
2004/0200922 A1 10/2004 Nakamura et al. ..... 242/596.5
2005/0236511 A1 * 10/2005 Martin ..... B65H 16/021 242/557
2009/0178581 A1 * 7/2009 Paita ..... B41F 19/068 101/27
2011/0076083 A1 * 3/2011 Tsurui ..... B65H 19/126 400/611
2018/0257366 A1 * 9/2018 Chretien ..... B65H 19/126

OTHER PUBLICATIONS

Written Opinion dated Feb. 17, 2016 in corresponding PCT International Application No. PCT/EP2015/025076.

* cited by examiner

SYSTEM FOR SUPPORTING A REEL OF STAMPING FOIL, AN UNWINDER MODULE, A STAMPING MACHINE, AND A METHOD FOR POSITIONING A REEL

CROSS-REFERENCE TO RELATED APPLICATIONS

The present application is a 35 U.S.C. §§ 371 national phase conversion of PCT/EP2015/025076, filed Nov. 6, 2015, which claims priority of European Patent Application No. 14020090.8, filed Nov. 21, 2014, the contents of which are incorporated by reference herein. The PCT International Application was published in the French language.

TECHNICAL BACKGROUND

The present invention relates to a system for supporting a reel of stamping foil, an unwinder module for stamping foil fitted with at least one such supporting device for a reel of stamping foil, a stamping machine for manufacturing packaging, including at least one such device for positioning reels of stamping foil, and a stamping machine for manufacturing packaging fitted with an unwinder module, including at least one such reel positioning device. The invention also relates to a method for positioning a reel of stamping foil in an unwinder module for stamping foil.

In the domain of packaging manufacture, for example packaging intended for the luxury-goods market, a machine for shaping by stamping applies motifs to a sheet element by pressure application. The motifs, for example text and/or decoration that is usually metallic, are obtained using a stamping plate or form. The motifs come from portions of a film transferred from one or more stamping foils.

In the stamping machine, the sheet elements to be stamped are drawn from a stack located upstream and are subsequently taken by a conveyor to a platen stamping press carrying the stamping plate. The stamping plate is mounted on the upper fixed traverse of the press. A stamping counterpart corresponding to the stamping plate is mounted on the lower moveable traverse of the press. In the case of hot stamping, known as hot foil stamping, the stamping plate is heated. The metallic stamping foils are conveyed between the movement plane of the sheet elements and the upper traverse.

With an upward vertical movement, the lower moveable traverse presses the stamping foil against each sheet element between the stamping plate and the counterpart of same to apply the film portions thereto. Once the film has been applied, the lower traverse goes back down and the stamped sheet element is then released by the clamp bar onto a stack in a reception area, leaving space for the next sheet element.

In the same period of time, the stamping foil is moved such that a new film surface is aligned with the stamping plate. Conveyance of the foils requires intermittent unwinding and advancing means usually comprising rollers against which the foils are clamped by pinch rollers. Motorized driving of these rollers enables the intermittent advance of these foils.

Most motifs applied to packaging can be applied using stamping foil of limited width, usually not exceeding 30 cm. However, it is sometimes necessary to use wider stamping foil, typically around 50 cm to 140 cm width. A group of narrower foils placed side by side, the aggregate width of which reaches this order of magnitude, can also be used.

Each stamping foil is packaged as a reel that is mounted movably in rotation about itself. The reel is unwound using a feed shaft or an oscillating roller which draws the foil directly. The reels of stamping foil are stored in an unwinder module. The module is used to hold the reels and to feed the machine with the foil or foils. In practice, the feed shaft is designed to turn at a variable speed since the foil is advanced sequentially inside the platen press, unlike an oscillating roller, which draws continuously from the reel when in use. To ensure optimum foil tension, the reel is permanently braked by applying a braking torque to it, the torque having a torque intensity which is steadily reduced as unwinding progresses. However, since the reel has mass and therefore relatively high inertia, it is particularly difficult for it to follow such a succession of accelerations, decelerations and pauses.

PRIOR ART

The operator is required to assemble the reel or reels in the unwinder module. Such reels are usually quite heavy and costly on account of the material used for the stamping, which may typically be gold or another precious metal. The document WO 2013/143664 describes a system including lifting means.

Since a reel can weigh up to 300 kg, these reels are difficult to position, and the operator also risks damaging a reel when assembling it in the module, which is not economically acceptable, given the high cost of a reel.

DESCRIPTION OF THE INVENTION

A first intended objective of the present invention is to provide simple and effective technical means to enable such stamping reels to be mounted safely and easily in a machine, in particular in the module used.

According to the present invention, a system for supporting stamping foil reels in an unwinder module for stamping foil reels, in which the stamping foil reel is mounted rotatably, includes:

two flanges, rigidly connected to the shaft of the reel of stamping foil, and each of the two flanges has a rotary shaft;

two ends that can be mounted on a guide surface of the unwinder module, and each of the two ends having at least one notch, in which the notch or notches are oriented upwards, and in which the notch or notches are arranged to receive the shaft of each flange; and a braking device adapted to cooperate with the reel of stamping foil and to slow rotation of the reel.

The foil is defined, as a non-exhaustive example, as a metallic foil, for example aluminized, gold, colored or others. The invention so defined has the advantage of simultaneously offering a simple system for mounting reels in the module or in a stamping machine, and also a braking device that is effective and easy to implement. The loading time of a reel is also reduced.

In another aspect of the invention, an unwinder module for at least one reel of stamping foil for a stamping machine is fitted with at least one system for supporting a reel of stamping foil with one or more of the technical features described below.

According to another aspect of the invention, a machine for stamping motifs on a sheet element has at least one system for supporting a reel of stamping foil with one or more of the technical features described below.

According to another aspect of the invention, a machine for stamping motifs on a sheet element includes an unwinder module with one or more of the technical features described below. The sheet element is defined, as a non-exhaustive example, as a material such as paper, flat cardboard, corrugated cardboard, laminated corrugated cardboard, flexible plastic such as polyethylene (PE), polyethylene terephthalate (PET), biaxially oriented polypropylene (BOPP) or other polymers, or other materials.

According to another aspect of the invention, a method for positioning a reel of stamping foil in an unwinder module for at least one reel of stamping foil for a stamping machine is implemented using a support system having one or more of the technical features described below. The method for positioning the reel includes the following steps:

placing a support system on the guide surface of the unwinder module;

installing the side flanges of the two sides of the reel of stamping foil;

positioning the reel on the two ends of the support system, using the rotary shaft of each of the side flanges;

rolling the reel of stamping foil on the two ends of the support system as far as the notches;

inserting the rotary shaft of each of the side flanges into the corresponding notches; and causing the braking device to cooperate with the reel of stamping foil.

BRIEF DESCRIPTION OF THE DRAWINGS

The invention and the different advantages and features of same are further explained in the following example, non-limiting description of an embodiment provided below with reference to the schematic drawings attached, in which.

DESCRIPTION OF PREFERRED EMBODIMENTS

Figure 1:
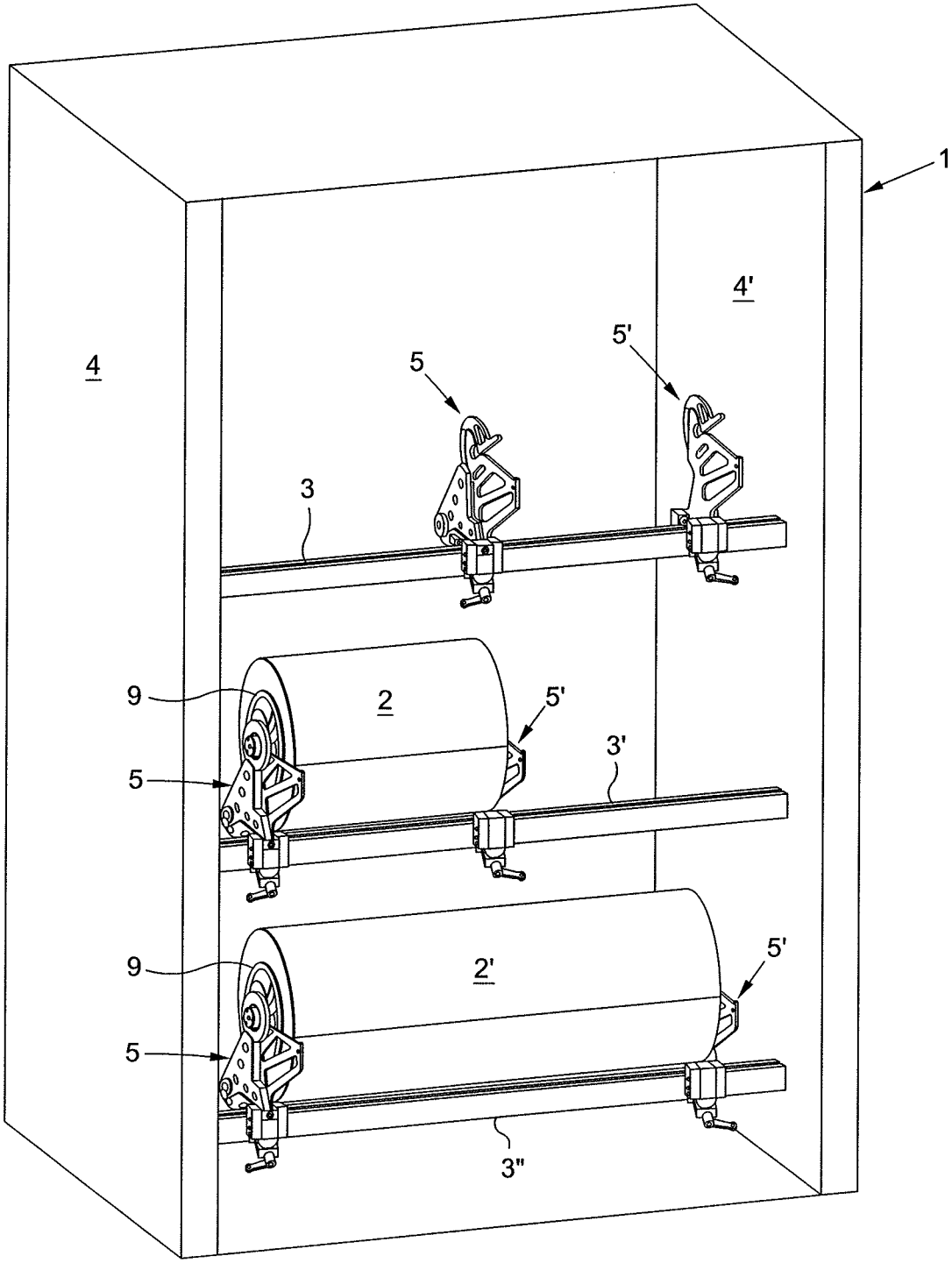
FIG. 1 is a perspective view of an unwinder module of at least one reel of stamping foil.

FIG. 1 is a perspective view of a reel-carrier/unwinder module 1 in which the reels 2 and 2' are installed. Each reel 2 and 2' is mounted on a cross member or guide surface 3, 3' and 3" that is attached to the side walls 4 and 4' of the module 1. Each cross member 3, 3', 3" carries at least one reel support system. The support system includes a pair of adjustable side supports 5 and 5'. The reels 2 and 2' are held on each cross member 3' and 3" between the two side supports 5 and 5'.

The reels 2 and 2' are in this case of several different sizes, as a function of the stamping to be performed. Several reels 2 and 2' can also be arranged on each cross member 3, 3' and 3", for example two or more, to the extent that the size of each reel 2 and 2' enables such a side-by-side arrangement. The decision to use one or more reels 2 and 2' per cross member 3, 3' and 3" may be determined by the stamping to be carried out.

Figure 2:
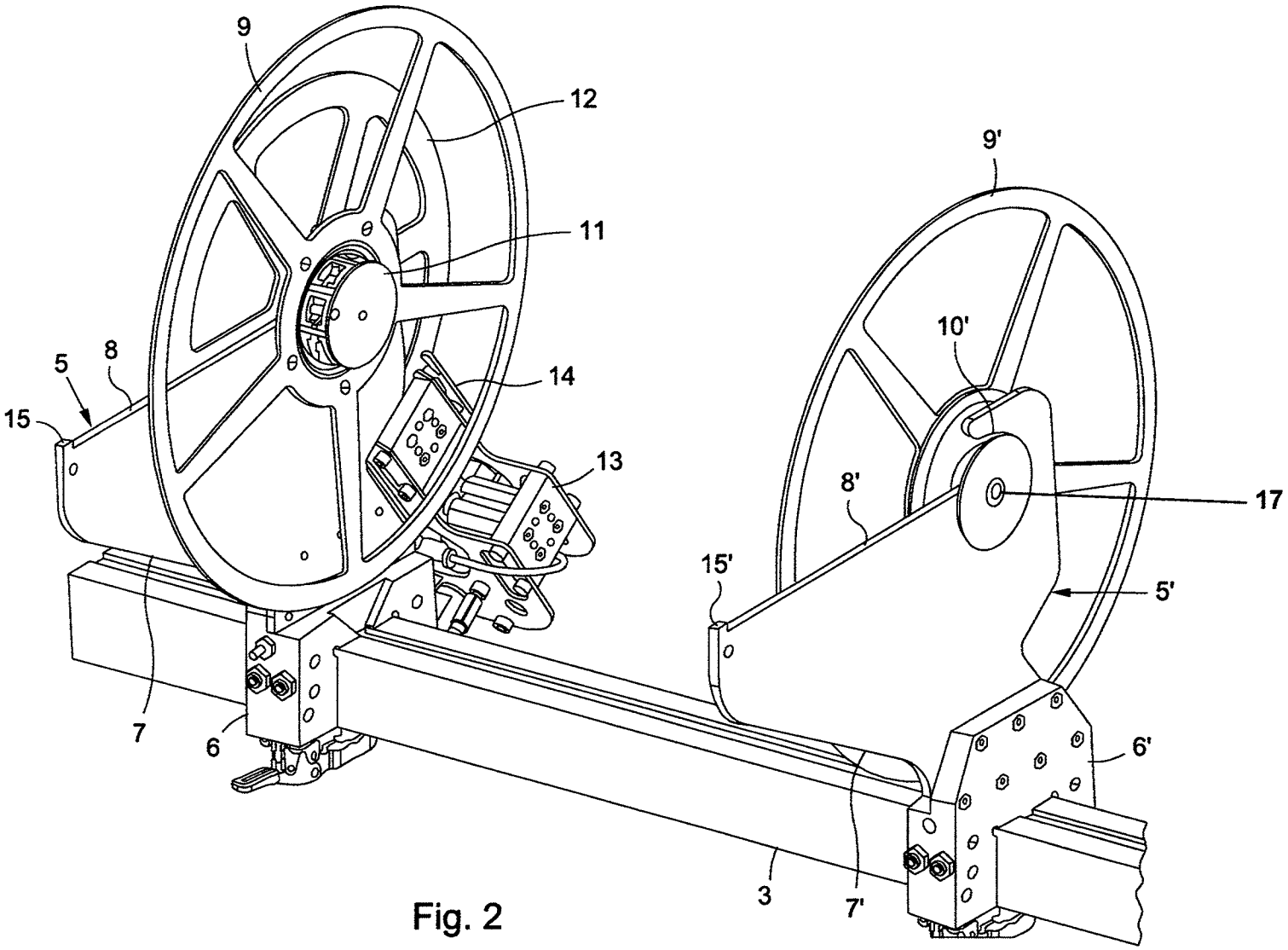
FIG. 2 is a perspective view of a system for supporting a reel according to a first embodiment of the invention.
Figure 3:
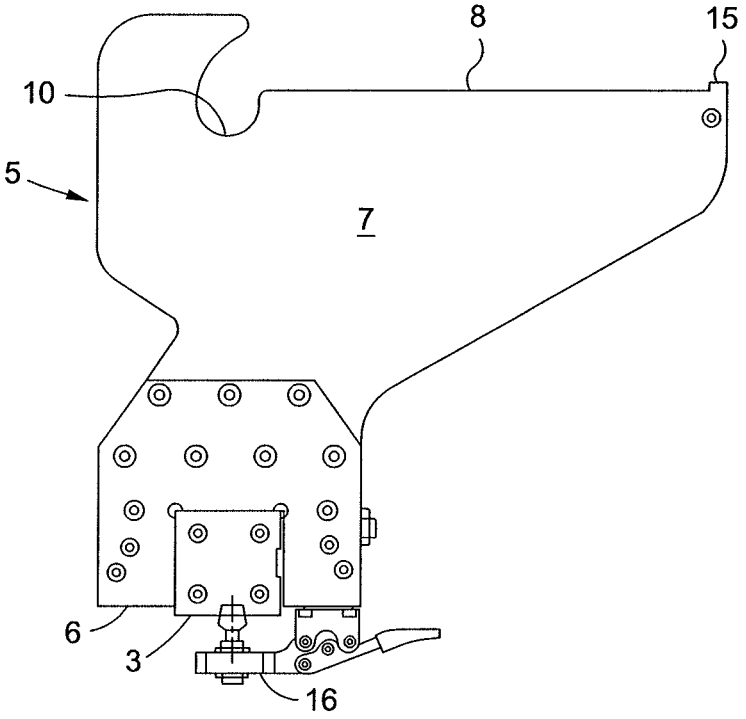
FIG. 3 is a side view of the support system in FIG. 2, without a reel.

FIGS. 2 and 3 show a first embodiment of the system for supporting a reel in the module 1, on a cross member 3. More specifically, the support system includes two supports 5 and 5' each provided with a foot 6 and 6' that is mounted on the cross member 3. Each foot 6 and 6' is locked in a given position, for example using a screw clamping system. When loose, the supports 5 and 5' can be moved laterally on the cross member 3 to adjust to the size of the reel 2.

The supports 5 and 5' also include a wall or end 7 and 7' that is mounted on the feet 6 and 6', for example by screwing or welding or any other equivalent means. Each wall 7 and 7' has an elongate upper edge 8 and 8'.

To carry a reel 2, a pair of flanges 9 and 9' each have a shaft 17 extending outwardly on one side (the outside) that each cooperate with a respective notch 10 and 10' formed in the respective upper edge 8 and 8' in the end wall 7 and 7'. On the other side inwardly extending side (inside) of the flanges 9 and 9', a respective expanding hub 11 and 11' rigidly connects and locks each flange 9 and 9' to the shaft of the reel 2. Thus, each of a pair of flanges 9 and 9' is mounted on a respective reel 2 and 2' and is locked to the reel using the expanding hub 11 and 11'.

Figure 4:
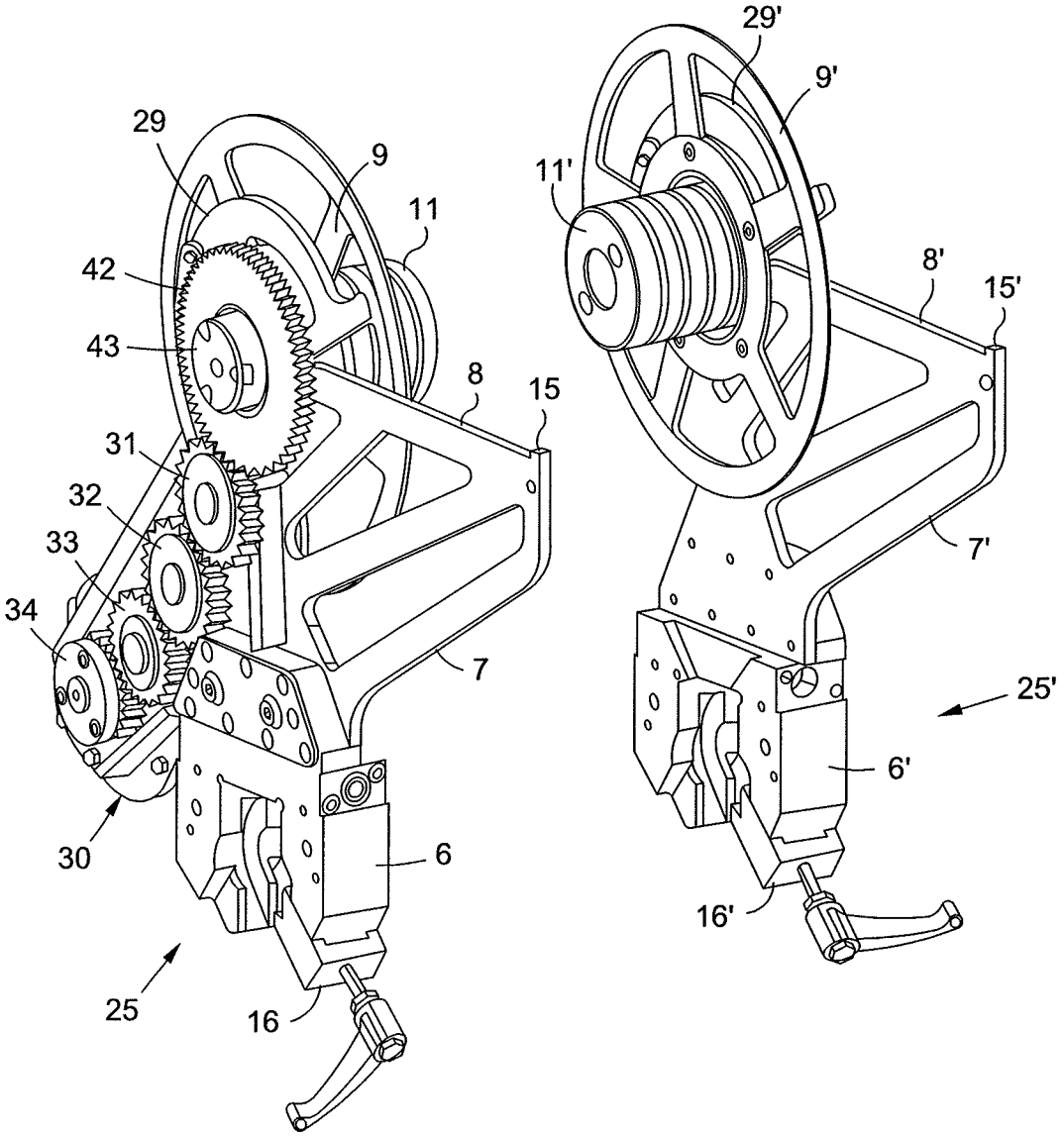
FIG. 4 is a perspective view of the system for supporting a reel according to a second embodiment of the invention.
Figure 6:
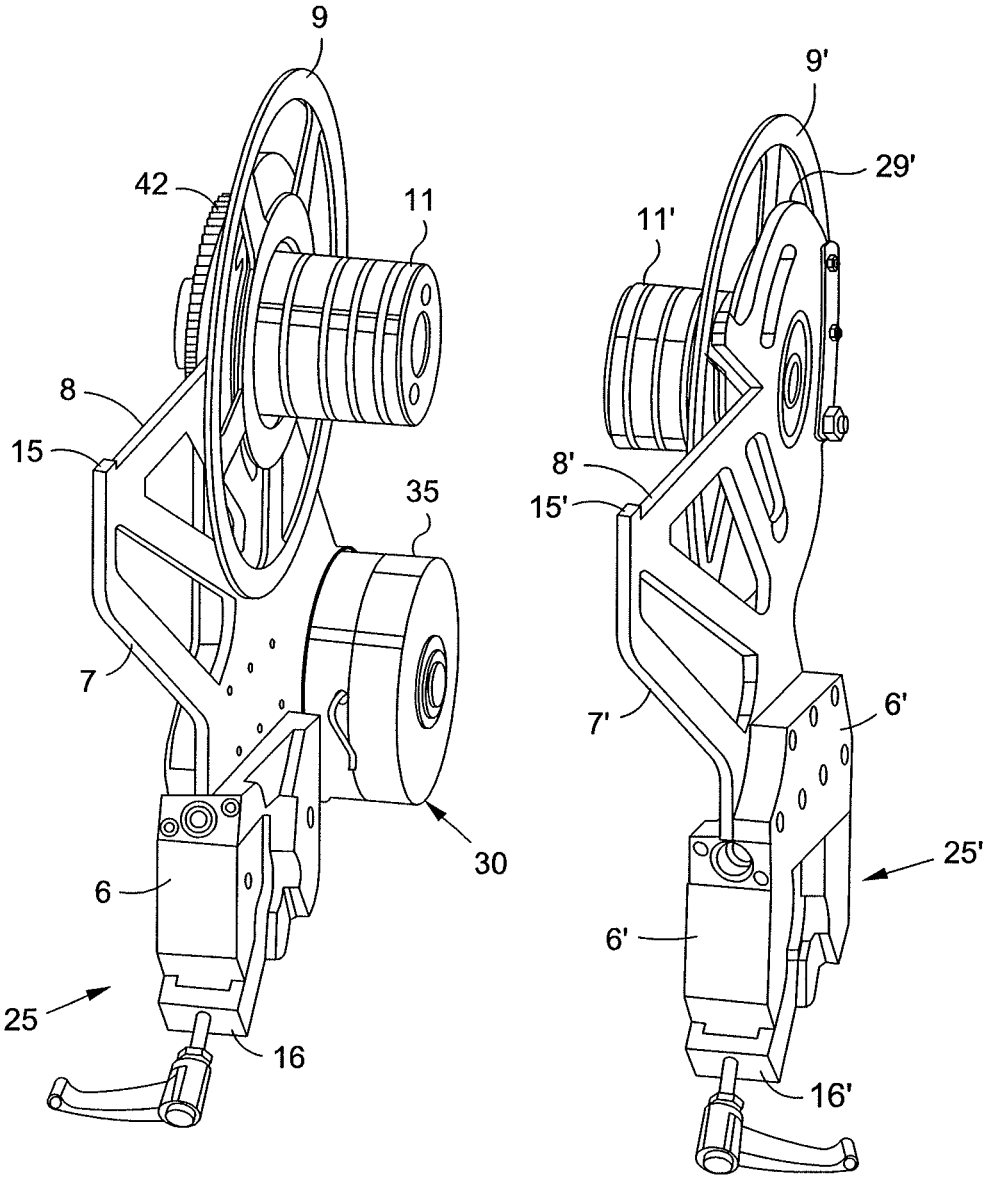
FIG. 6 is another perspective view of the support system in FIG. 4.

Once this assembly has been made and when the supports 5 and 5' have been attached to the cross member 3, 3' and 3", the operator can place the reel 2 and 2' with the flanges 9 and 9' on the edge 8 and 8' and roll the reel 2 and 2' towards the inside of the module 1 until the shafts 17 of the flanges 9 and 9' enter the notches 10 and 10' (as shown in FIGS. 2, 4 and 6).

The support system 5 and 5' also has a braking device. The braking device include a disk 12 attached to the shaft 17 of the flange 9, and a disk brake 13 on which a caliper 14 and pads act. The pads of the brake can for example be actuated using hydraulic pressure, or other equivalent means.

A stop 15 and 15' is provided toward or at the edge 8 and 8' of the wall 7 and 7', toward or at the end of the wall on the opposite the end from the notch 10 and 10'. As described above, attachment means 16 lock the support 5 and 5' on the cross member 3, 3', 3". The stop 15 and 15' prevents the reel 2 from coming back or returning and falling out of the support system 5 and 5'.

FIG. 4 shows a support in another embodiment of the support system 25 and 25' of the present invention. The principles set out above also apply to this embodiment, and the main difference lies in the braking devices used. Magnetic brakes 30 are used.

Figure 5:
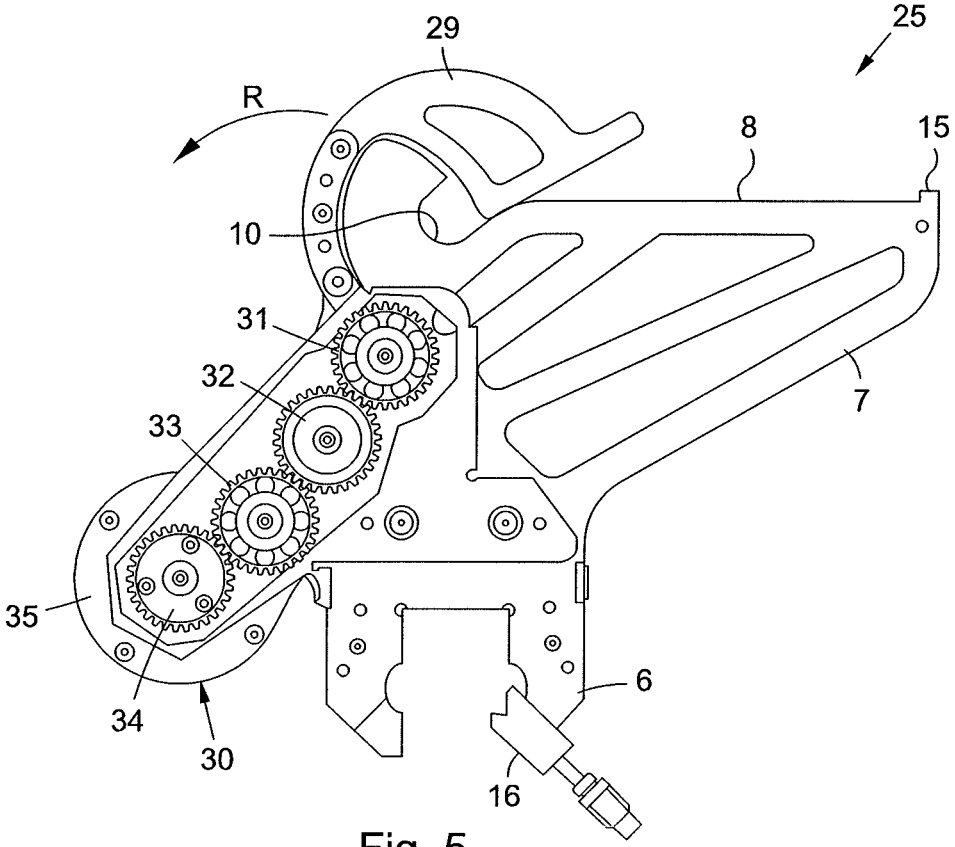
FIG. 5 is a side view of the support system in FIG. 4, without a reel.

More specifically, a support 25 notably shares the following elements with the first embodiment: a foot 6, an attachment device 16, an end wall 7, an edge 8 and a notch 10, which may be closed by a pivoting catch 29 and 29' (arrow R in FIG. 5). The cross member is not shown.

The magnetic braking device 30 include notably a gear train 31, 32, 33 and 34 and a magnetic element 35 that cooperates with and acts on the last gear 34 to adjust its speed, thereby acting as a brake to slow the rotation of the reel 2 and 2'. The magnetic braking device 30 includes the magnetic element 35 used to slow the gear 34, which is driven by the gear 42 on the flange 9.

The flanges 9 and 9' include respective expanding hubs 11 and 11'. The flange 9 on the left-hand side of the figure also has an axial gear 42 mounted on the shaft 43 of same. The axial gear 42 meshes with the first gear 31 of the braking means 30. In consideration of this meshing, it is preferable to use the catch 29 and 29' to prevent the flange 9 and therefore the reel 2 and 2' from moving during braking.

Overall, both embodiments work in the same way except for the braking device. The method for positioning the reel of stamping foil 2 in an unwinder module 1 for at least one reel of stamping foil for a stamping machine includes several stages.

A first stage involves placing the support system 5 and 5' or 25 and 25' on the guide surface 3.

A second stage involves installing the side flanges 9 and 9' of the two sides of the reel 2.

A third stage involves positioning the reel 2 on the two ends 7 and 7' using the rotary shaft of each of the side flanges 9 and 9'. A reel 2 and 2' with flanges 9 and 9' is brought into the module 1 and the shafts 9 and 9' are placed on the edge 8.

A fourth stage involves rolling the reel 2 on the two ends 7 and 7', and more specifically on the edge 8 and 8' of the two ends 7 and 7', as far as the notches 10 in the two ends 7 and 7'. The flanges 9 and 9' are moved, for example by rotation, until the shafts of same have entered the notches 10.

A fifth stage involves inserting the rotary shaft of each of the side flanges 9 and 9' into each of the notches 10 and 10'. The shaft can then be locked in the notch 10 using the catch 29 and 29'. This catch 29 and 29' is required in this embodiment on account of the braking device 30 used.

A sixth stage involves causing the braking device 13 and 30 to cooperate with the reel 2. In the first embodiment, the disk 12 of the support system 5 and 5' is inserted into the caliper 14 of the braking device 13. In the second embodiment, the axial gear 42 of the braking device 30 of the support system 25 and 25' is meshed with the first gear 31 of the braking means 30.

Other types of braking devices could be used, such as a rim brake applied to one of the flanges 9. The reels of stamping foil 2 and 2' can be positioned using the support systems according to the invention by being mounted one on top of another, as with the unwinder module, or by being placed horizontally directly into the stamping machine, or by being placed diagonally.

The present invention is not limited to the embodiments described and illustrated. Numerous modifications can be made without thereby moving outside the scope of the claims.

The invention claimed is:

1. A system for supporting a reel of stamping foil in an unwinder module, in which the reel is mounted rotatably, the system comprising:

two flanges connected to and spaced apart to receive and hold the reel between the flanges, each flange having a respective rotary shaft extending outward of the reel;

an unwinder configured to unwind the reel of stamping foil;

two ends mounted on guides, each end having an upwardly oriented notch located and arranged to receive the shaft of a respective one of the flanges so that the rotary shaft may rotate along with the flange, while the shaft is in the notch; and a braking device, separate from the unwinder, and configured to cooperate with and to brake rotation of the reel, wherein the braking device includes a disk brake including at least one brake caliper configured to act on the brake disk connected to one of the flanges.

2. A system according to claim 1, further comprising a respective foot attached to each end, and each foot is mounted slidingly on the guide.

3. A system according to claim 1, further comprising each end has a respective upper edge with an upwardly oriented stop located toward one side of the upper edge and the one side is opposite a second side of the upper edge with the notch formed in the upper edge toward the second side.

4. A system according to claim 1, wherein each flange comprises at least one expanding hub to which the reel is attached, thereby holding each reel to rotate.

5. A system according to claim 1, further comprising a respective catch connected to and movable with respect to each flange for closing or opening the notch.

6. An unwinder module for at least one reel of stamping foil for a stamping machine, and the unwinder module is fitted with at least one support system according to claim 1.

7. A module according to claim 6, including several stages arranged sequentially on top of one another, wherein each stage includes at least one guide surface on which at least one of the support systems is mounted.

8. A machine for stamping motifs on a sheet element, fitted with a module according to claim 6.

9. A machine for stamping motifs on a sheet element including at least one support system according to claim 1.

10. A method for positioning a reel of stamping foil in an unwinder module for at least one reel of stamping foil in a stamping machine, including a support system according to claim 1, and the method comprising:

placing the support system on the guide;

installing the reel between the two side flanges;

positioning the reel on the two ends using the rotary shaft of each flange for the positioning;

rolling the reel on the two ends, to respective ones of notches formed in the ends;

inserting the rotary shaft of each of the side flanges into the respective and corresponding notches in the ends; and causing the braking device to cooperate with the reel for braking the reel.

11. A system according to claim 1, further comprising an inwardly extending hub on each flange to position the reel.

12. A system according to claim 1, wherein each flange includes a hub extending inward toward the other flange, and the hub is configured to support each reel placed for operation of the system on the reel.

13. The system according to claim 1, wherein the braking device includes:

the brake disk attached to the flange; and a selective device configured to selectively engage and brake rotation of the flange and thereby of the reel.

14. A system for supporting a reel of stamping foil in an unwinder module, in which the reel is mounted rotatably, the system comprising:

two flanges connected to and spaced apart to receive and hold the reel between the flanges, each flange having a respective rotary shaft extending outward of the reel;

an unwinder configured to unwind the reel of stamping foil;

two ends mounted on guides, each end having an upwardly oriented notch located and arranged to receive the shaft of a respective one of the flanges so that the rotary shaft may rotate along with the flange, while the shaft is in the notch; and a braking device, separate from the unwinder, and configured to cooperate with and to brake rotation of the reel, wherein the braking device includes an electromagnetic brake including a gear train.

15. A system according to claim 14, wherein the electromagnetic brake includes:

the gear train at one of the flanges, an axial gear connected to the at least one of the flanges, at least one of the gears of the gear train engaging the axial gear, and another of the gears in the gear train cooperating with an electromagnetic element of the brake.

16. A system for supporting a reel of stamping foil in an unwinder module, in which the reel is mounted rotatably, the system comprising:

two flanges connected to and spaced apart to receive and hold the reel between the flanges, each flange having a respective rotary shaft extending outward of the reel;

an unwinder configured to unwind the reel of stamping foil;

two ends mounted on guides, each end having an upwardly oriented notch located and arranged to receive the shaft of a respective one of the flanges so that the rotary shaft may rotate along with the flange, while the shaft is in the notch; and a braking device, separate from the unwinder, and configured to cooperate with and to brake rotation of the reel, wherein the braking devices is located and configured to brake the flange rotation, wherein the braking device includes a brake disk attached to the flange and a device for selectively engaging and braking rotation of the flange and thereby of the reel.

17. A system for supporting a reel of stamping foil in an unwinder module, in which the reel is mounted rotatable, the system comprising:

two flanges connected to and spaced apart to receive and hold the reel between the flanges, each flange having a respective rotary shaft extending outward of the reel;

an unwinder configured to unwind the reel of stamping foil;

two ends mounted on guides, each end having an upwardly oriented notch located and arranged to receive the shaft of a respective one of the flanges so that the rotary shaft may rotate along with the flange, while the shaft is in the notch; and a braking device, separate from the unwinder, and configured to cooperate with and to brake rotation of the reel, wherein the braking device is a magnetic braking device including a gear train and a magnetic element configured to cooperate and to act on a last gear of the gear train so as to adjust a speed of the last gear.

* * * * *